US010575703B2

(12) United States Patent
Harrington et al.

(10) Patent No.: US 10,575,703 B2
(45) Date of Patent: Mar. 3, 2020

(54) VERSATILE CLEANING DEVICES

(71) Applicant: Unger Marketing International, LLC, Bridgeport, CT (US)

(72) Inventors: William Harrington, Charlestown, RI (US); James M. Buckley, New Hartford, CT (US); Robert F. Smith, Waterbury, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 167 days.

(21) Appl. No.: 14/985,486

(22) Filed: Dec. 31, 2015

(65) Prior Publication Data

US 2016/0318173 A1 Nov. 3, 2016

Related U.S. Application Data

(60) Provisional application No. 62/154,649, filed on Apr. 29, 2015.

(51) Int. Cl.

| | |
|---|---|
| ***A47L 13/258*** | (2006.01) |
| ***B25G 1/06*** | (2006.01) |
| ***A47L 13/38*** | (2006.01) |

(52) U.S. Cl.

CPC ..... *A47L 13/258* (2013.01); *A47L 13/38* (2013.01); *B25G 1/06* (2013.01)

(58) Field of Classification Search

CPC ..... A47L 13/38; A47L 13/258; A47L 13/46; B25G 1/06

USPC ..... 15/144.1, 234

See application file for complete search history.

(56) References Cited

U.S. PATENT DOCUMENTS

| | | | |
|---|---|---|---|
| 656,468 | A | 8/1900 | Mullin et al. |
| 693,518 | A | 2/1902 | Hamilton |
| 731,338 | A | 6/1903 | Cattelle |
| D736,741 | S | 8/1903 | Klemm |
| D952,746 | | 3/1910 | Lane |
| 1,068,683 | A | 7/1913 | Malek |
| 1,315,901 | A | 9/1919 | Ballinger |

(Continued)

FOREIGN PATENT DOCUMENTS

| | | |
|---|---|---|
| DE | 3520187 | 12/1986 |
| GB | 2085789 | 5/1982 |
| WO | 0006347 | 2/2000 |

OTHER PUBLICATIONS

International Search Report and Written Opinion of the International Searching Authority dated Feb. 26, 2016 for corresponding PCT/US2015/068211, 10 pages.

*Primary Examiner* — Laura C Guidotti

(74) *Attorney, Agent, or Firm* — Cantor Colburn LLP

(57) ABSTRACT

A versatile cleaning device is provided that can be easily configured for a number of different cleaning tasks and in a number of different positions. The device allows the user to change and/or replace to the cleaning head and/or the cleaning member carried by the head. The device allows the user to change a first angle between the handle and the extension arm via a pivot assembly. Further, the device allows the user to secure the handle to an extension device for greater reach and cleaning range. Accordingly, the cleaning device allows for even increased reach and cleaning range, as well as allowing the device to be folded for easy and compact storage/shipping.

19 Claims, 16 Drawing Sheets

(56) References Cited

U.S. PATENT DOCUMENTS 1,353,490 A 9/1920 Pantalek
1,452,893 A 4/1923 Porth
1,463,745 A 7/1923 Layne
1,500,132 A 7/1924 Hummelgard
1,603,914 A 10/1926 Hermann
1,584,021 A 5/1928 Melvin
1,864,011 A 6/1932 Brown
2,032,664 A 3/1936 Raptis
2,119,045 A 5/1938 Deitrich
2,145,985 A 2/1939 Krajicek
2,245,096 A 6/1941 Penney
2,276,026 A 3/1942 Davidson, Jr.
2,286,190 A 6/1942 Abrahamsen
2,336,284 A 12/1943 Nelson
2,376,887 A 5/1945 Walters
2,730,800 A 1/1956 Bailey
2,783,537 A 3/1957 Gringer
2,846,764 A 8/1958 Hyneman
2,862,296 A 12/1958 Anderson
2,948,961 A 8/1960 Ortner
2,993,222 A * 7/1961 Laymon ..... B25G 3/38
15/144.1
3,107,426 A 10/1963 Robinson, Jr.
3,132,371 A 5/1964 Enos et al.
3,162,947 A 12/1964 Gringer
3,192,624 A 7/1965 Gringer
3,250,000 A 5/1966 Schumman
3,577,637 A 5/1971 Braginetz
3,667,122 A 6/1972 Black
3,688,401 A 9/1972 Hartman
3,781,988 A 1/1974 Jones
3,879,847 A 4/1975 Roll
3,892,039 A 7/1975 Fisher
3,906,627 A 9/1975 Manning
D240,370 S 7/1976 Kuehl
D240,699 S 7/1976 Gerson
4,005,525 A 2/1977 Gringer
4,086,698 A 5/1978 Sparks
4,091,537 A 5/1978 Stevenson, Jr.
4,103,421 A 8/1978 Quenot
4,115,892 A 9/1978 Stickler
4,139,939 A 2/1979 Crooks
4,200,977 A 5/1980 Kageyama et al.
4,242,795 A 1/1981 Rollband et al.
D267,826 S 2/1983 Gringer
D274,952 S 7/1984 Gringer
D274,953 S 7/1984 Gringer
4,558,517 A 12/1985 Gringer
D282,881 S 3/1986 Gringer
4,574,417 A 3/1986 Magnasco
4,587,735 A 5/1986 Walters et al.
4,621,425 A 11/1986 Stoutenberg
4,660,284 A 4/1987 Decarolis
4,805,304 A 2/1989 Knoop
4,817,284 A 4/1989 Sacherman et al.
4,835,865 A 6/1989 Knoop
4,922,569 A 5/1990 Brinker et al.
D313,507 S 1/1991 Sawyer
4,987,682 A 1/1991 Minnick
D314,696 S 2/1991 Lucrelli
5,012,581 A 5/1991 Fletcher et al.
5,022,156 A 6/1991 Kallens et al.
5,025,558 A 6/1991 Gilbert
5,031,322 A 7/1991 Jacoff
D319,147 S 8/1991 Eberle, III
D319,378 S 8/1991 Wilcox
5,036,591 A 8/1991 Cousins
5,056,226 A 10/1991 Gringer
5,099,539 A 3/1992 Forester
D326,546 S 5/1992 Gringer
5,110,230 A 5/1992 Cole, Jr. et al.
5,121,544 A 6/1992 Gilbert
5,141,517 A 8/1992 Shutt
5,164,871 A 11/1992 Hughes et al.
5,175,902 A 1/1993 Samuelsson
D332,901 S 2/1993 Campbell
5,241,750 A 9/1993 Chomiak
5,265,969 A 11/1993 Chuang
5,289,637 A 3/1994 Coffey
5,293,791 A 3/1994 Allen et al.
D346,319 S 4/1994 Lavallee et al.
5,299,355 A 4/1994 Boda et al.
5,330,494 A 7/1994 van der Westhuizen et al.
5,386,632 A 2/1995 Shmidt
5,400,509 A 3/1995 Collins
RE34,979 E 6/1995 Gringer
5,426,855 A 6/1995 Keklak et al.
5,433,004 A 7/1995 Thompson et al.
5,435,064 A 7/1995 Brookfield
5,445,981 A 8/1995 Lee
D364,252 S 11/1995 Henke
5,471,698 A 12/1995 Francis et al.
5,481,804 A 1/1996 Platts
5,495,673 A 3/1996 Gardiner et al.
5,528,832 A 6/1996 Schmidt
5,528,834 A 6/1996 Seber et al.
5,545,175 A 8/1996 Abidin et al.
5,581,890 A 12/1996 Schmidt
5,581,893 A 12/1996 Oullette
5,613,300 A 3/1997 Schmidt
5,621,973 A 4/1997 Seber et al.
5,694,692 A 12/1997 Reinschreber
5,769,094 A 6/1998 Jenkins, Jr. et al.
5,806,189 A 9/1998 Bailey
5,813,121 A 9/1998 Gringer
5,852,874 A 12/1998 Walker
5,878,501 A 4/1999 Owens et al.
5,890,290 A 4/1999 Davis
D411,429 S 6/1999 Gringer
5,911,761 A 6/1999 Tilley
5,956,788 A 9/1999 Henke
D420,882 S 2/2000 Majolo et al.
6,018,836 A 2/2000 Williams
6,026,575 A 2/2000 Wonderley
6,035,536 A 3/2000 Dewberry
6,044,562 A 4/2000 Dillenbeck
6,058,607 A 5/2000 Gringer
6,155,620 A 12/2000 Armstrong
6,161,290 A 12/2000 Takamasa
6,178,640 B1 1/2001 Votolato
D437,764 S 2/2001 Zimmerman
D439,128 S 3/2001 Wass
6,219,878 B1 4/2001 Dewberry
6,219,923 B1 4/2001 Sinisi et al.
6,263,577 B1 7/2001 Wonderley
6,286,215 B1 9/2001 Panaccione
6,317,986 B1 11/2001 Huang
D453,251 S 1/2002 Gringer
6,334,254 B1 1/2002 Wonderley
6,349,473 B1 2/2002 Schmidt
6,352,888 B1 3/2002 Kim
6,354,007 B1 3/2002 Scarla
6,415,514 B1 7/2002 Chun
6,438,849 B1 8/2002 Wonderley
D463,639 S 9/2002 Panfili et al.
6,453,559 B1 9/2002 Marshall et al.
D467,395 S 12/2002 McCool
6,487,778 B1 12/2002 Gringer et al.
D468,989 S 1/2003 Gringer et al.
6,519,801 B1 2/2003 Chao
6,530,098 B1 3/2003 Gringer et al.
6,568,087 B1 5/2003 Gringer
6,578,229 B1 6/2003 Dziallas et al.
6,578,266 B2 6/2003 Chomiak
D478,493 S 8/2003 Martone et al.
D479,374 S 9/2003 Gringer et al.
D479,375 S 9/2003 Gringer et al.
D480,228 S 10/2003 Delillo
6,643,936 B2 11/2003 Carlson et al.
6,688,003 B2 2/2004 Scarla
D489,851 S 5/2004 Jones et al.
6,732,395 B2 5/2004 Gringer
6,742,951 B2 6/2004 Schultz et al.
6,748,659 B1 6/2004 Street

(56) References Cited

U.S. PATENT DOCUMENTS

| | | | |
|---|---|---|---|
| 6,832,438 | B1 | 12/2004 | Gringer et al. |
| 6,907,668 | B2 | 6/2005 | Polei |
| 6,915,577 | B2 | 7/2005 | Scala |
| 6,931,690 | B2 | 8/2005 | Cox |
| 6,964,100 | B1 | 11/2005 | Misland et al. |
| 6,968,622 | B2 | 11/2005 | Ping |
| 6,990,705 | B1 | 1/2006 | Schouten et al. |
| D516,263 | S | 2/2006 | Gringer et al. |
| 7,000,282 | B2 | 2/2006 | Cox et al. |
| 7,007,392 | B2 | 3/2006 | Ping |
| 7,032,941 | B2 | 4/2006 | Heneveld |
| 7,040,022 | B2 | 5/2006 | Ping |
| 7,055,204 | B2 | 6/2006 | Ajluni |
| 7,055,407 | B2 | 6/2006 | Gringer et al. |
| D531,003 | S | 10/2006 | Collinds |
| 7,134,207 | B2 | 11/2006 | Ping |
| 7,155,770 | B2 | 1/2007 | Anderson et al. |
| D537,591 | S | 2/2007 | Gringer et al. |
| D549,543 | S | 8/2007 | Tsai |
| 7,293,317 | B2 | 11/2007 | Tsuchiya et al. |
| 7,325,313 | B2 | 2/2008 | Gringer et al. |
| D564,161 | S | 3/2008 | Talesfore et al. |
| 7,346,988 | B2 | 3/2008 | Gringer et al. |
| 7,350,998 | B2 | 4/2008 | Walsh, III |
| 7,380,341 | B2 | 6/2008 | Ping |
| 7,413,366 | B2 | 8/2008 | Bensussan |
| 7,415,769 | B2 | 8/2008 | Hughes |
| D584,871 | S | 1/2009 | Arvinte et al. |
| 7,475,480 | B2 | 1/2009 | Votolato |
| 7,480,997 | B2 | 1/2009 | Ping |
| 7,600,287 | B1 | 10/2009 | Moore et al. |
| 7,617,559 | B2 | 11/2009 | Jiang |
| D605,911 | S | 12/2009 | Lian et al. |
| D606,375 | S | 12/2009 | Divita |
| 7,694,422 | B2 | 4/2010 | Vaes |
| D622,114 | S | 8/2010 | Balliet |
| 7,797,835 | B2 | 9/2010 | Zeng |
| 7,802,340 | B2 | 9/2010 | Knopow et al. |
| 7,814,664 | B2 | 10/2010 | LeBlanc et al. |
| 7,891,898 | B2 | 2/2011 | Hoadley et al. |
| D634,600 | S | 3/2011 | Gringer et al. |
| 7,913,349 | B2 | 3/2011 | Byrnes |
| 8,046,922 | B2 | 11/2011 | Eby et al. |
| 8,171,646 | B2 | 5/2012 | Chiu |
| 8,214,964 | B1 | 7/2012 | Coleman |
| 8,356,415 | B2 | 1/2013 | Lin |
| 8,438,688 | B2 | 5/2013 | Weinberger et al. |
| 8,495,784 | B2 | 7/2013 | Steinhardt et al. |
| 8,544,146 | B2 | 10/2013 | Curien |
| 8,959,698 | B2 * | 2/2015 | Prosser ..... B25G 3/38 15/144.1 |
| 2002/0078518 | A1 | 6/2002 | Jiang |
| 2002/0124412 | A1 | 9/2002 | Votolato |
| 2002/0124418 | A1 | 9/2002 | Votolato |
| 2003/0110570 | A1 | 6/2003 | Gringer |
| 2003/0110641 | A1 | 6/2003 | Gringer |
| 2004/0045167 | A1 | 3/2004 | Gringer et al. |
| 2004/0142647 | A1 | 7/2004 | Goulet et al. |
| 2005/0097753 | A1 | 5/2005 | Gringer et al. |
| 2005/0097756 | A1 | 5/2005 | Gringer et al. |
| 2005/0193568 | A1 | 9/2005 | Peyrot et al. |
| 2006/0080843 | A1 | 4/2006 | Gringer et al. |
| 2006/0162106 | A1 | 7/2006 | Ross |
| 2006/0260084 | A1 | 11/2006 | Guizzi |
| 2007/0169353 | A1 | 7/2007 | Wu |
| 2008/0052856 | A1 | 3/2008 | Lin |
| 2008/0083118 | A1 | 4/2008 | Steigerwalt et al. |
| 2008/0163493 | A1 | 7/2008 | Votolato |
| 2008/0289190 | A1 | 11/2008 | Jennings et al. |
| 2009/0199409 | A1 | 8/2009 | Zeng |
| 2009/0313836 | A1 | 12/2009 | Wei |
| 2010/0162509 | A1 | 7/2010 | Liao |
| 2010/0162573 | A1 | 7/2010 | Liao |
| 2010/0263214 | A1 | 10/2010 | Robinson et al. |
| 2011/0056035 | A1 * | 3/2011 | Burbacki ..... A46B 5/0033 15/144.1 |
| 2011/0114118 | A1 | 5/2011 | Gracindo et al. |
| 2011/0167647 | A1 | 7/2011 | Gringer et al. |
| 2013/0174364 | A1 | 7/2013 | Cheng et al. |
| 2013/0185943 | A1 | 7/2013 | Landwehr |
| 2013/0239345 | A1 | 9/2013 | Giustetto |
| 2014/0130827 | A1 * | 5/2014 | Dotterman ..... A47L 13/34 134/6 |

* cited by examiner

VERSATILE CLEANING DEVICES

CROSS REFERENCE TO RELATED APPLICATIONS

This application claims the benefit of U.S. Provisional Application Ser. No. 62/154,649 filed Apr. 29, 2015, the contents of which are incorporated by reference herein.

BACKGROUND

1. Field of the Disclosure

The present disclosure is related to cleaning devices. More particularly, the present disclosure is related to versatile cleaning devices that can be easily configured for a number of different cleaning tasks and in a number of different positions.

2. Description of Related Art

Residential and commercial cleaning requires the cleaning all different types of surfaces, where the surfaces can be in different locations and in hard to reach places. In many instances, specialized cleaning devices have been designed to meet each cleaning task—which results in a burdensome number of different cleaning devices being needed to clean a living or working space.

Accordingly, it has been determined by the present disclosure that there is a continuing need for versatile cleaning devices that overcome, alleviate, and/or mitigate one or more of the aforementioned and other problems associated with prior art devices.

SUMMARY

A versatile cleaning device is provided that can be easily configured for a number of different cleaning tasks and in a number of different positions. The device allows the user to change and/or replace to the cleaning head and/or the cleaning member carried by the head. The device allows the user to change a first angle between the handle and the extension arm via a pivot assembly. Further, the device allows the user to secure the handle to an extension device for greater reach and cleaning range. Accordingly, the cleaning device allows for even increased reach and cleaning range, as well as allowing the device to be folded for easy and compact storage/shipping.

A versatile cleaning device is provided that includes a handle defining a first axis, an extension arm defining a second axis, a head attaching assembly, and a pivot assembly. The head attaching assembly secures a plurality of cleaning heads to the extension arm. The pivot assembly secures the handle and extension arm to one another for rotational movement about a pivot axis among a first position, at least one intermediate position, and a second position. The first and second axes are perpendicular to one another in the first position, but are parallel to one another in the second position.

A versatile cleaning device is also provided that include a handle, an extension arm, a head attaching assembly, and a pivot assembly. The head attaching assembly secures a plurality of cleaning heads to the extension arm. The pivot assembly secures the handle and extension arm to one another for rotational movement about a pivot axis. The pivot assembly includes a first housing, a second housing, a gear lock, a biasing member, and a release button. The first housing depends from one of the handle and the extension arm, while the second housing depending from the other one of the handle and the extension arm. The gear lock is in the first and second housings for sliding movement along the pivot axis. The first and second housings and the gear lock all have a corresponding number of teeth, respectively. The gear lock having a width that is less than or equal to a depth of the second housing so that the gear lock can slide along the pivot axis into the second housing with the teeth of the gear lock being engaged with only the teeth of the second housing. The biasing member is in one of the first and second housings, the biasing member normally biasing the gear lock to a position in which the teeth of the gear lock are engaged with the teeth of both the first and second housings to lock the pivot assembly in position against rotation about the pivot axis. The release button extends from one of the first and second housings. The release button abuts the gear lock so that a pressure applied to the release button over comes the biasing force of the bias member and slides the gear lock along the pivot axis into the second housing to unlock the pivot assembly for rotation about the pivot axis.

A versatile cleaning device is also provided that includes a handle defining a first axis, an extension arm defining a second axis and having a first attaching feature, a first cleaning head having a second attaching feature, and a pivot assembly. The first and second attaching features removably secure the first cleaning head to the extension arm. The pivot assembly secures the handle and extension arm to one another for rotational movement about a pivot axis among a first position, at least one intermediate position, and a second position. The pivot assembly has a release button that selectively allows or prevents movement among the first, intermediate, and second positions.

The above-described and other features and advantages of the present disclosure will be appreciated and understood by those skilled in the art from the following detailed description, drawings, and appended claims.

DETAILED DESCRIPTION

Figure 1:
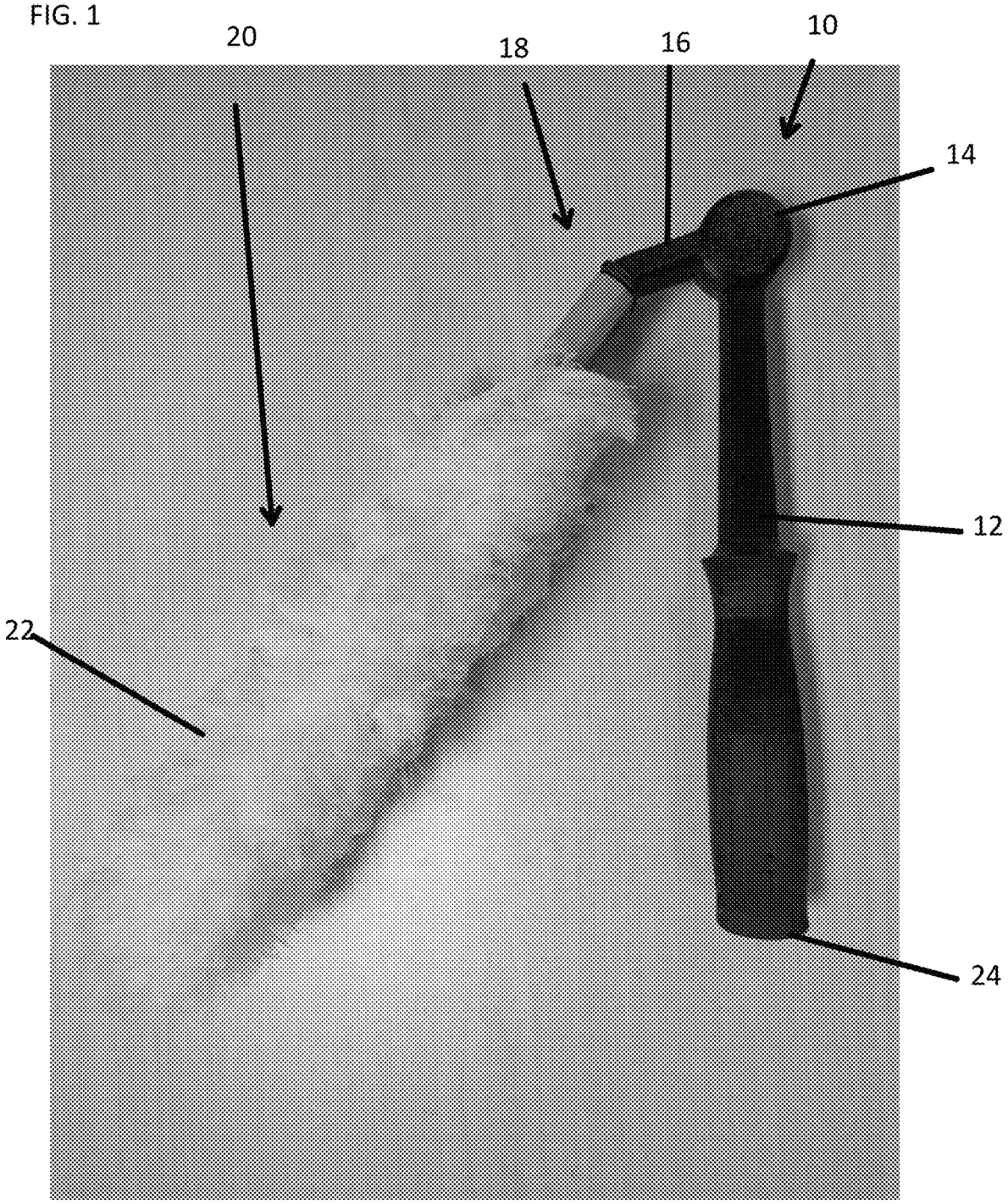
FIG. 1 is a side view of a versatile cleaning device according to an exemplary embodiment of the present disclosure in use with a first cleaning head.
Figure 2:
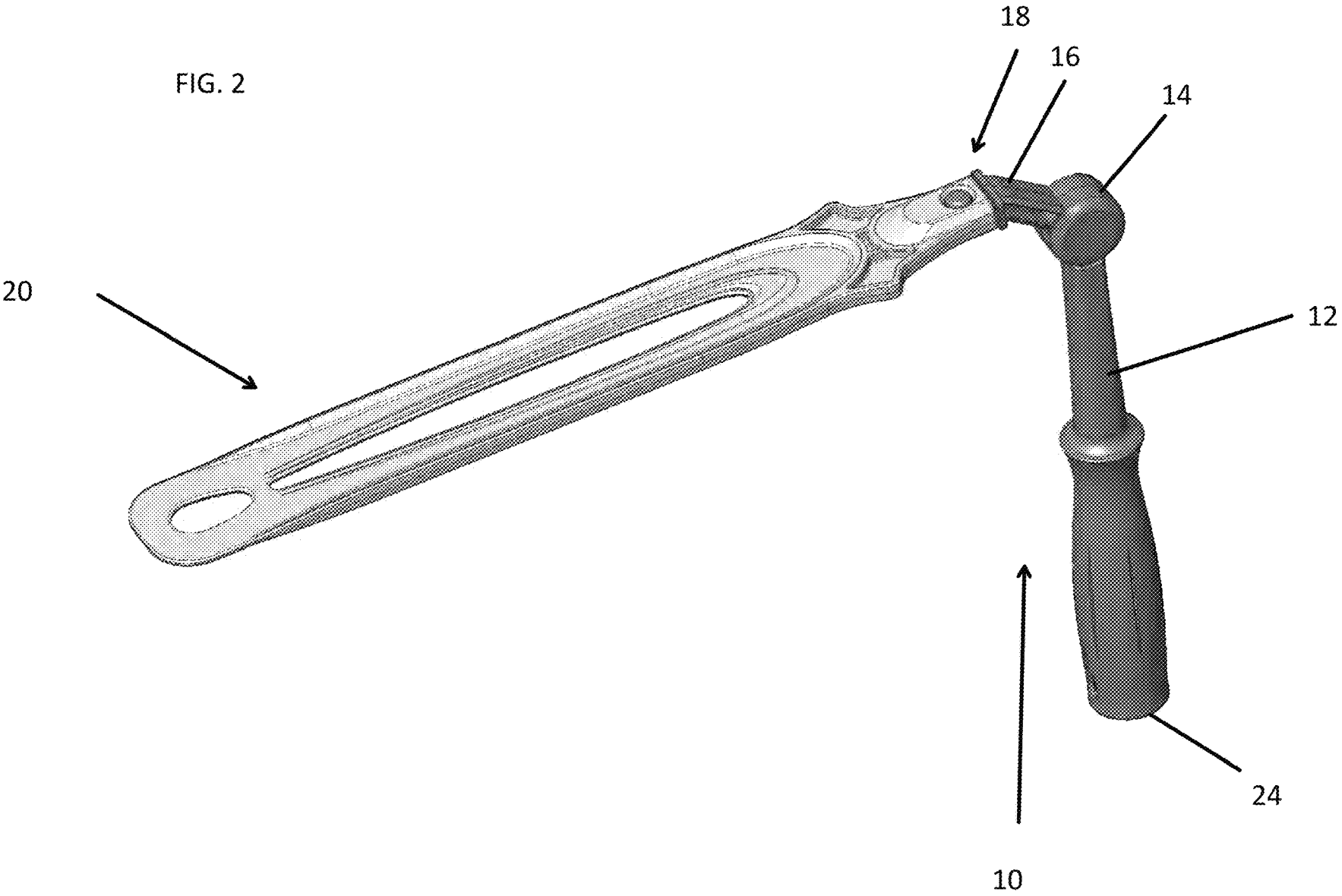
FIG. 2 is a perspective view of the cleaning device of FIG. 1 having a cleaning member removed from the first cleaning head.
Figure 3:
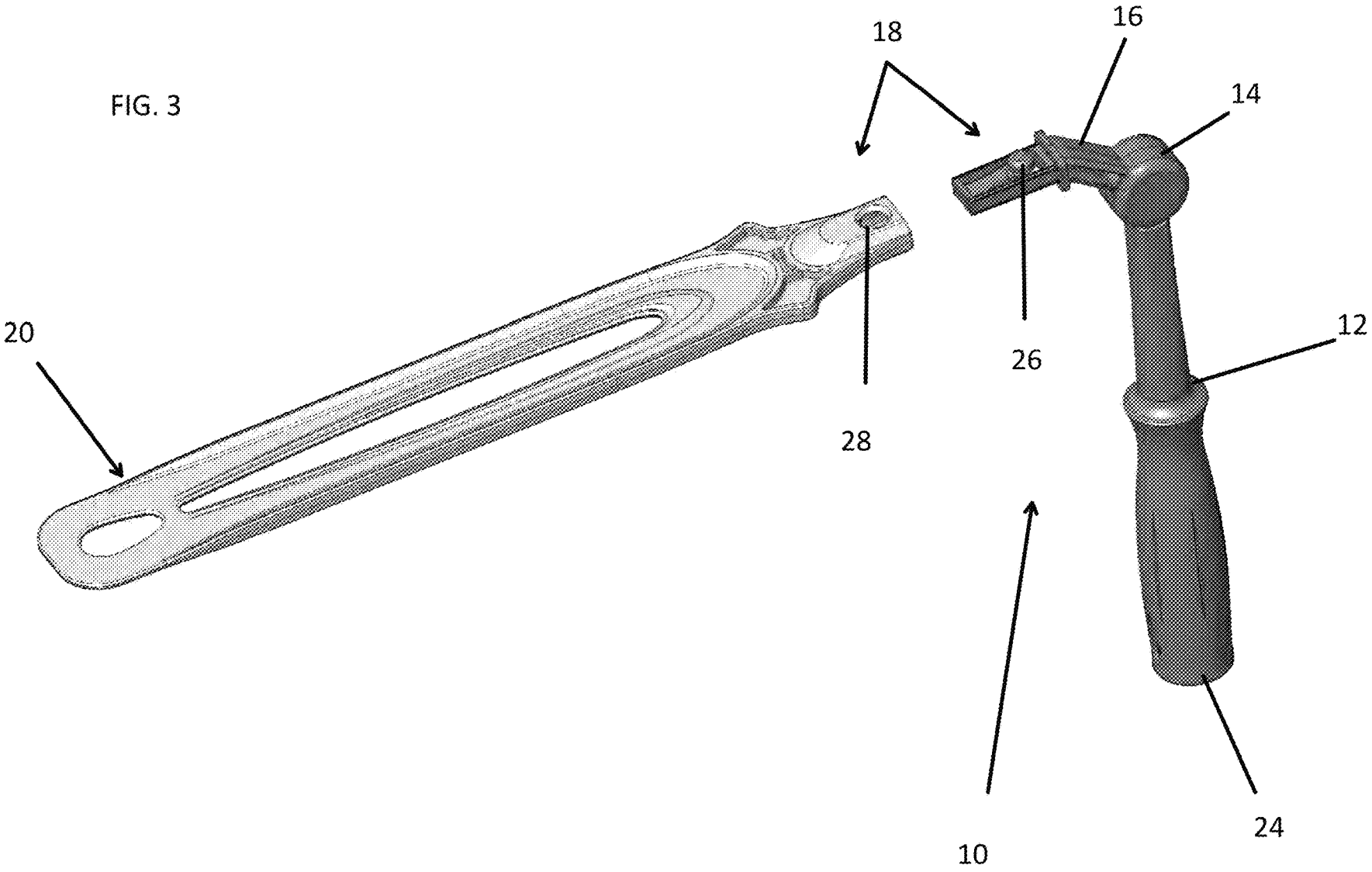
FIG. 3 is a perspective view of the cleaning device of FIG. 1 having the first cleaning head removed from a handle.

Referring to the drawings and in particular to FIGS. 1-3, an exemplary embodiment of a versatile cleaning device according to the present disclosure is shown and is generally referred to by reference numeral 10. Advantageously and as is described in more detail below, versatile cleaning device 10 is configured to be easily configured for a number of different cleaning tasks and in a number of different positions.

Device 10 includes a handle 12, a pivot assembly 14, an extension arm 16, and a head attaching assembly 18, which allows a first cleaning head 20 to be removably secured thereto. First cleaning head 20 includes a cleaning member 22 that can be used to perform one or more cleaning operations.

For purposes of clarity, device 10 is described herein by way of example with the cleaning operation described as a dusting operation—such that cleaning member 22 is illustrated as a dusting cloth or dusting element. Here, first cleaning head 20 is illustrated as a delicate duster.

Of course, it is contemplated by the present disclosure for the cleaning operation to be operations other than dusting such as, but not limited to, window cleaning, floor cleaning, surface wiping, surface scraping, and any other cleaning operation—as well as any combinations thereof.

Handle 12 and a portion of pivot assembly 14 are illustrated as being integrally formed. Similarly, extension arm 16 and another portion of pivot assembly 14 are illustrated as being integrally formed. Of course, it is contemplated by the present disclosure for these components to be separately formed and joined to one another in any desired manner. Handle 12, preferably, includes a free end 24 that is configured to removably receive an extension device (not shown)—such as an extension handle, a pole, a telescoping pole, and any combinations thereof—that allows the reach of device 10 be increased as needed.

FIG. 2 illustrates cleaning device 10 having cleaning member 22 (e.g., dusting cloth) removed from first cleaning head 20, while FIG. 3 illustrates the operation of head attaching assembly 18—where the first cleaning head is removed from extension arm 16.

Head attaching assembly 18 includes a first feature 26 on extension arm 16 and a second feature 28 on first cleaning head 20. In the illustrated embodiment, first feature 26 is illustrated as a flexible release button, while second feature 28 is illustrated as an opening. Of course, it is contemplated by the present disclosure for head attaching assembly 18 to include any desired combination of first and second cooperating features 26, 28 that releasably secure head 20 to extension arm 16.

Head attaching assembly 18, in some embodiments where first feature 26 is the flexible release button and second feature 28 is the opening, preferably is configured to include a cam or lead in so that the action of attaching extension arm 16 and first cleaning head 20 acts to bias the first feature until the first feature is aligned with the second feature, at which time the release button returns to its normal state under its own resilience. In other embodiments where first feature 26 is the flexible release button, extension arm 16 can include one or more protrusions and/or indentations that prevent or at least mitigate the potential of over stroking the resilient portion of the flexible release button.

Device 10—by virtue of head attaching assembly 18—allows first cleaning head 20 to be removed and replaced with different cleaning heads.

Figure 4:
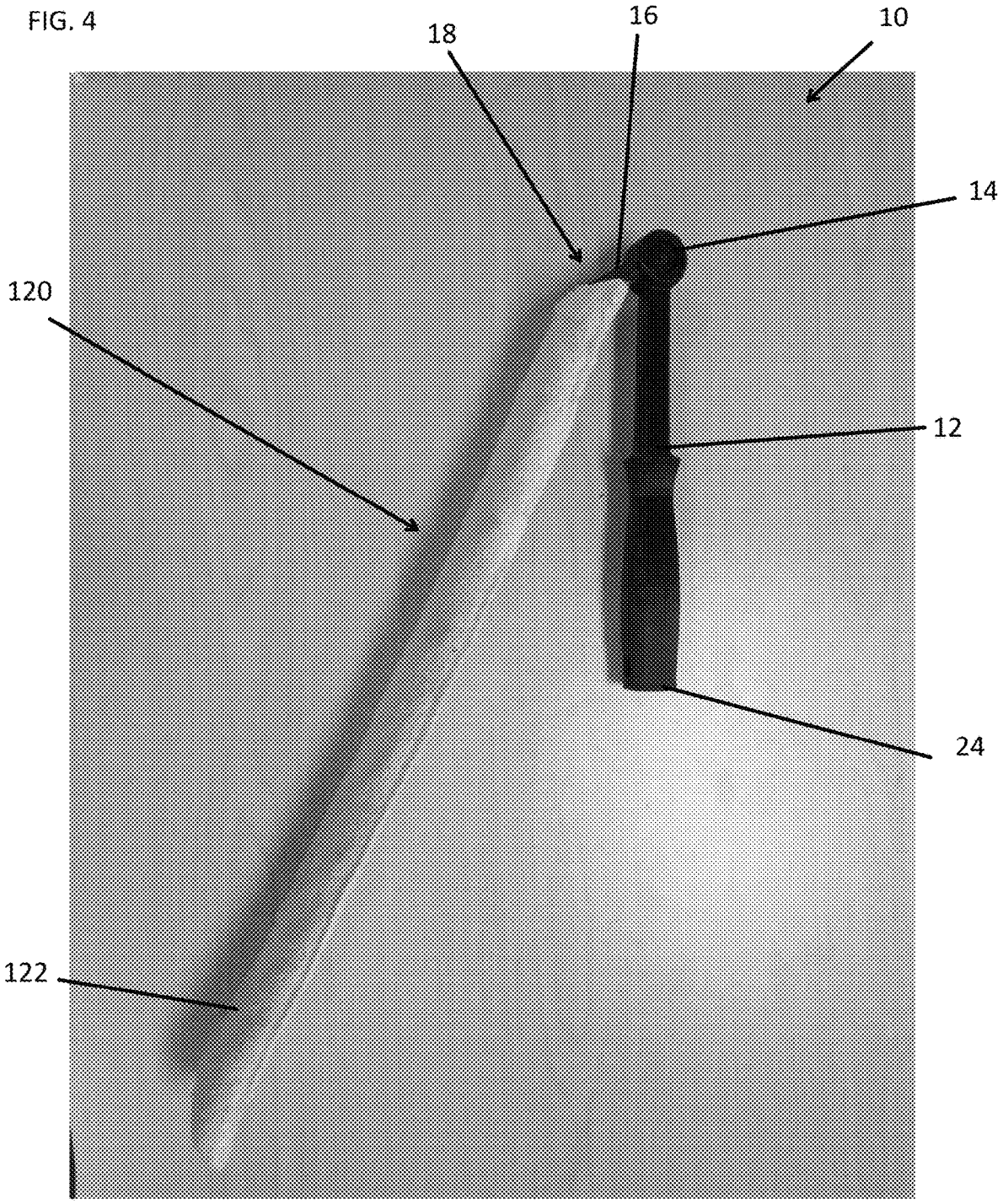
FIG. 4 is a side view of the versatile cleaning device according to the present disclosure in use with a second cleaning head.
Figure 5:
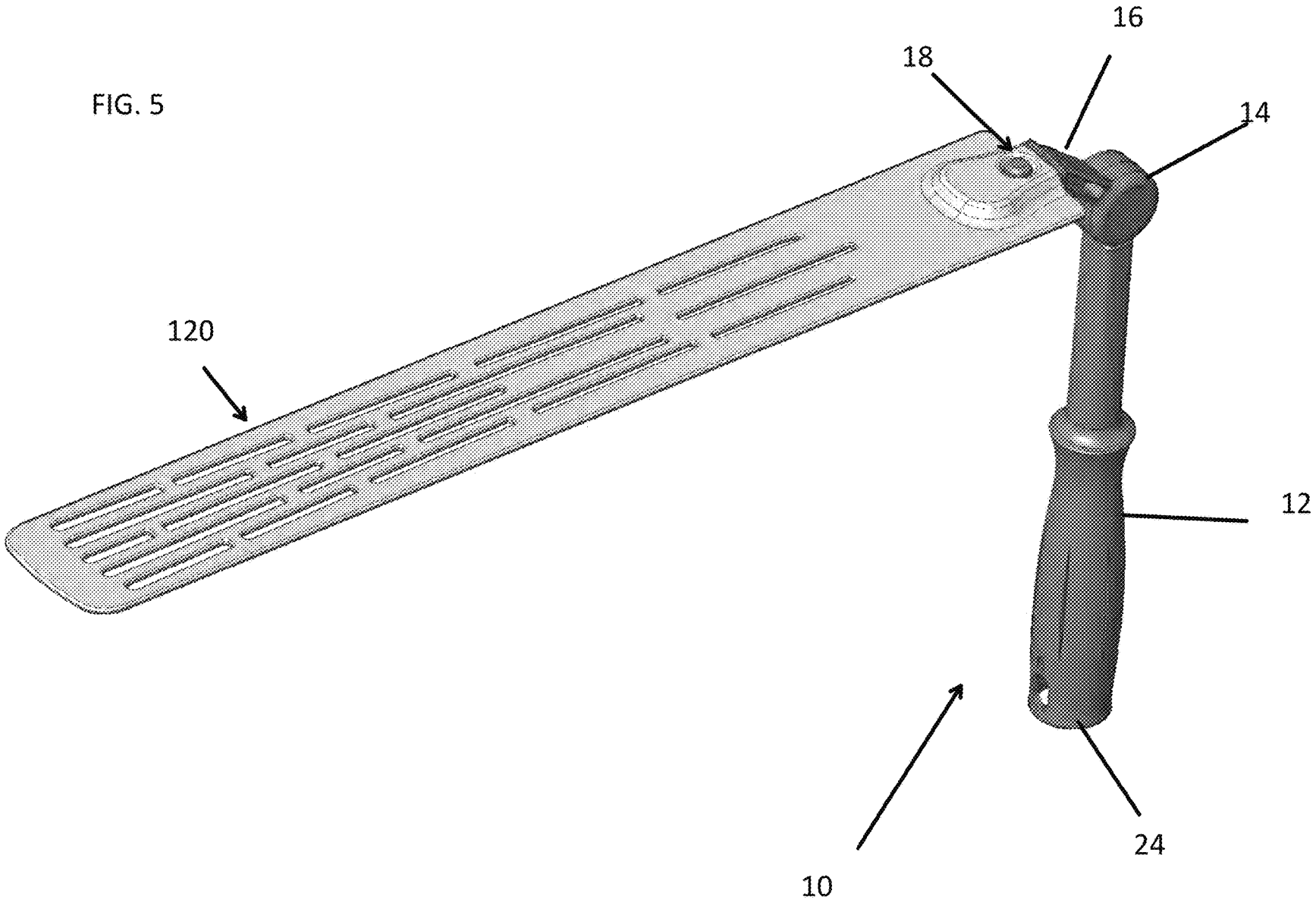
FIG. 5 is a perspective view of the cleaning device of FIG. 4 having a cleaning member removed from the second cleaning head.
Figure 6:
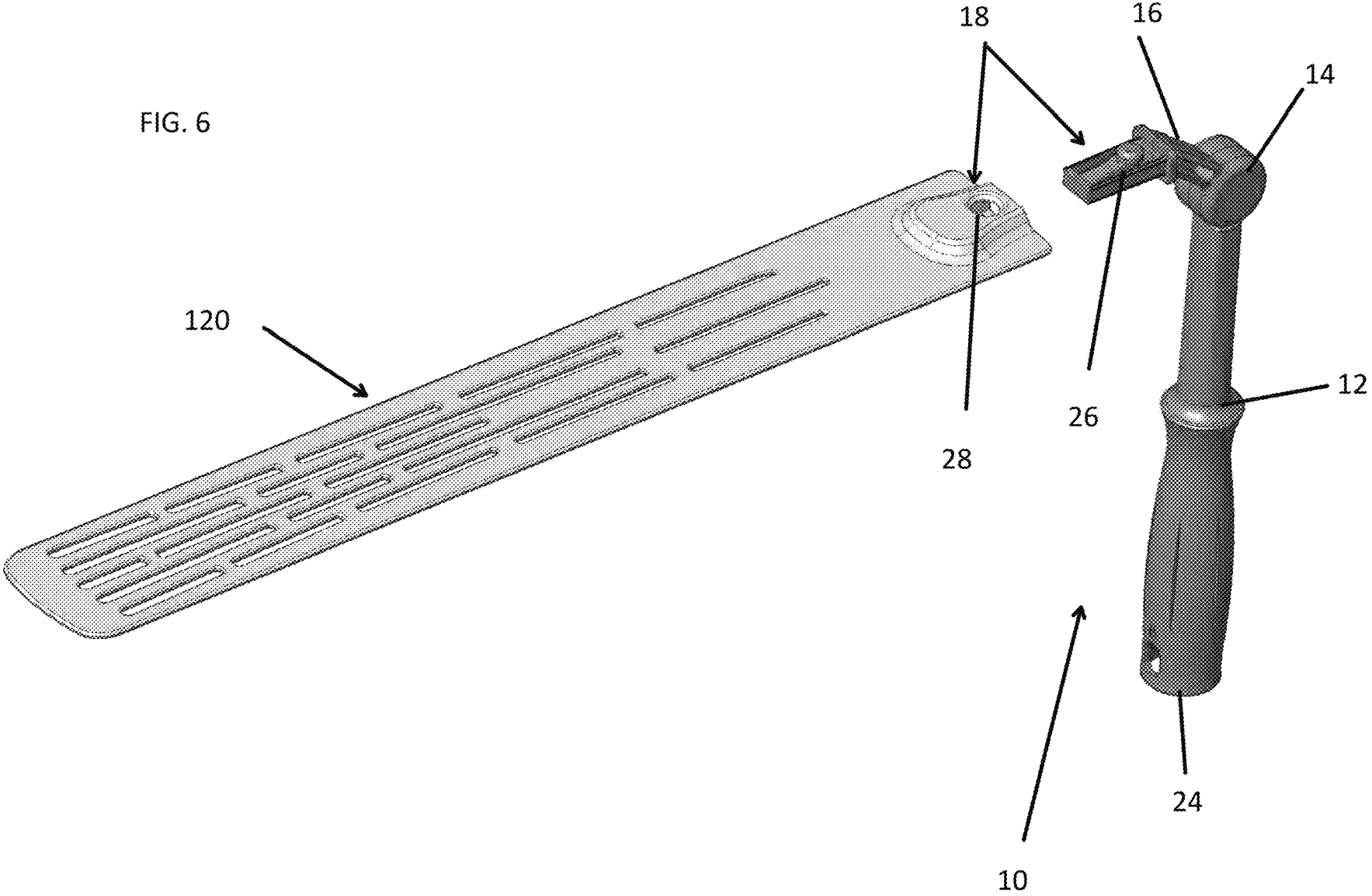
FIG. 6 is a perspective view of the cleaning device of FIG. 5 having the second cleaning head removed from the handle.

For example, device 10 is illustrated in FIGS. 4-6 in use with a second cleaning head 120—illustrated as a crevice duster. Device 10 is illustrated in FIG. 5 having cleaning device 122 removed from second cleaning head 120 and is illustrated in FIG. 6 having the second cleaning head removed from extension arm 16.

Since first and second cleaning heads 20, 120 both releaseably attach to the same head attaching assembly 18, it can be seen that the second cleaning head 120 also includes second feature 28.

Figure 7:
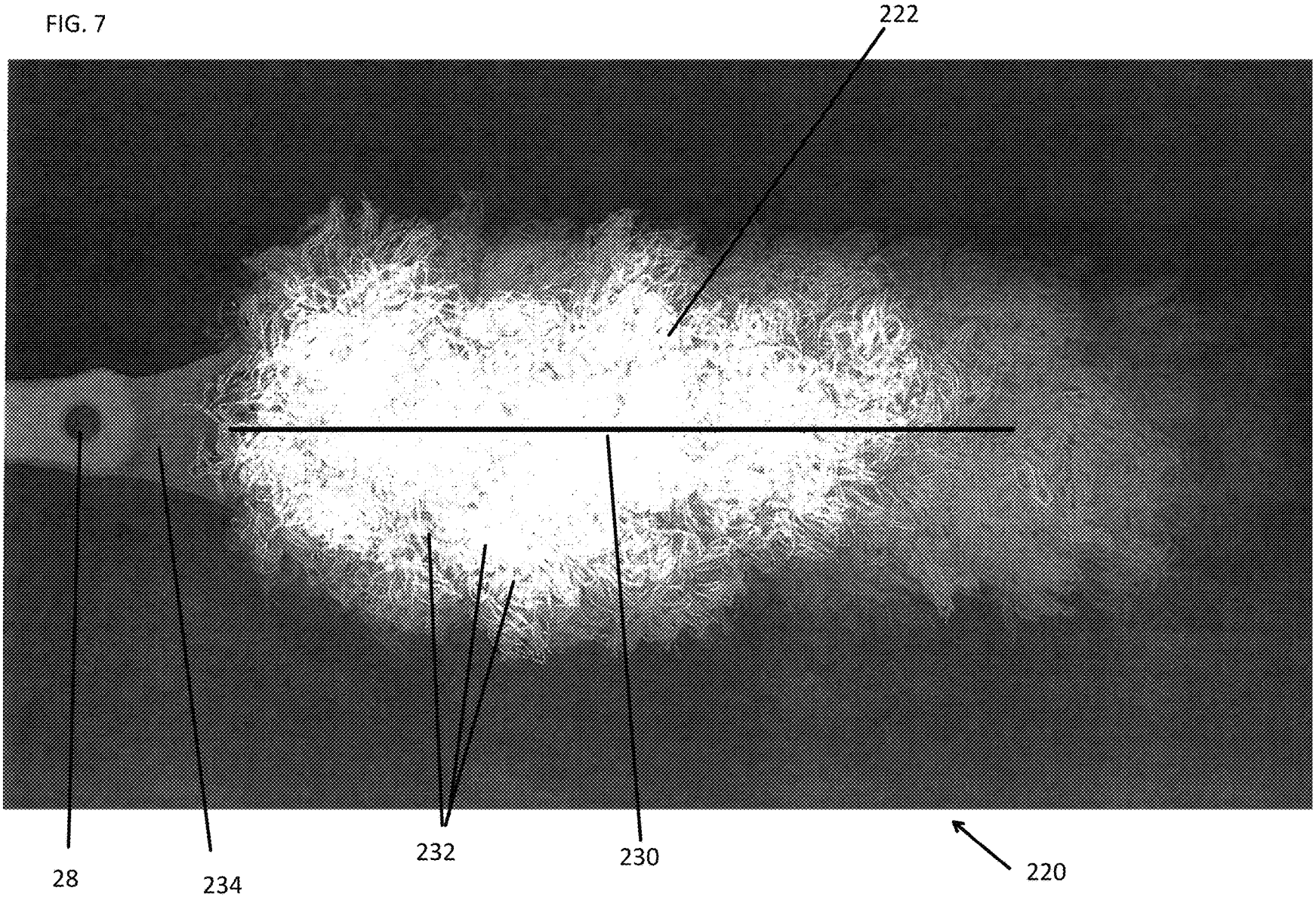
FIG. 7 is a top view of a third cleaning head according to an exemplary embodiment of the present disclosure for use with the cleaning device of FIG. 1.

Additionally, device 10 is illustrated in FIG. 7 in use with a third cleaning head 220—illustrated as a feather duster. Here and contrary to the first and second cleaning heads 20, 120, third cleaning head 220 has cleaning device 222 as an integral part of the head. Here, third cleaning head 220 includes at least two flexible wires (not shown) that are wrapped and/or intertwined around one another to form a flexible spine 230 and wrapped and/or intertwined around a plurality of fibers 232—illustrated as microfibers. Spine 230 is connected to or integrally formed with a carrier 234 that includes second feature 28.

Of course, it is contemplated by the present disclosure for third cleaning head 220 to be any other type of a feather duster such as, but not limited to, that disclosed in Applicant's own U.S. patent application Ser. Nos. 13/088,838 and 13/750,553—the contents of each of which are incorporated herein by reference thereto.

The operation of pivot assembly 14 are initially described with reference to FIGS. 8 and 9. Device 10 includes a first axis 40 that is defined along handle 12 and a second axis 42 that is defined by extension arm 16. Additionally and as shown in the illustrated embodiment, extension arm 16 can include one or more bends along second axis 42.

Figure 8:
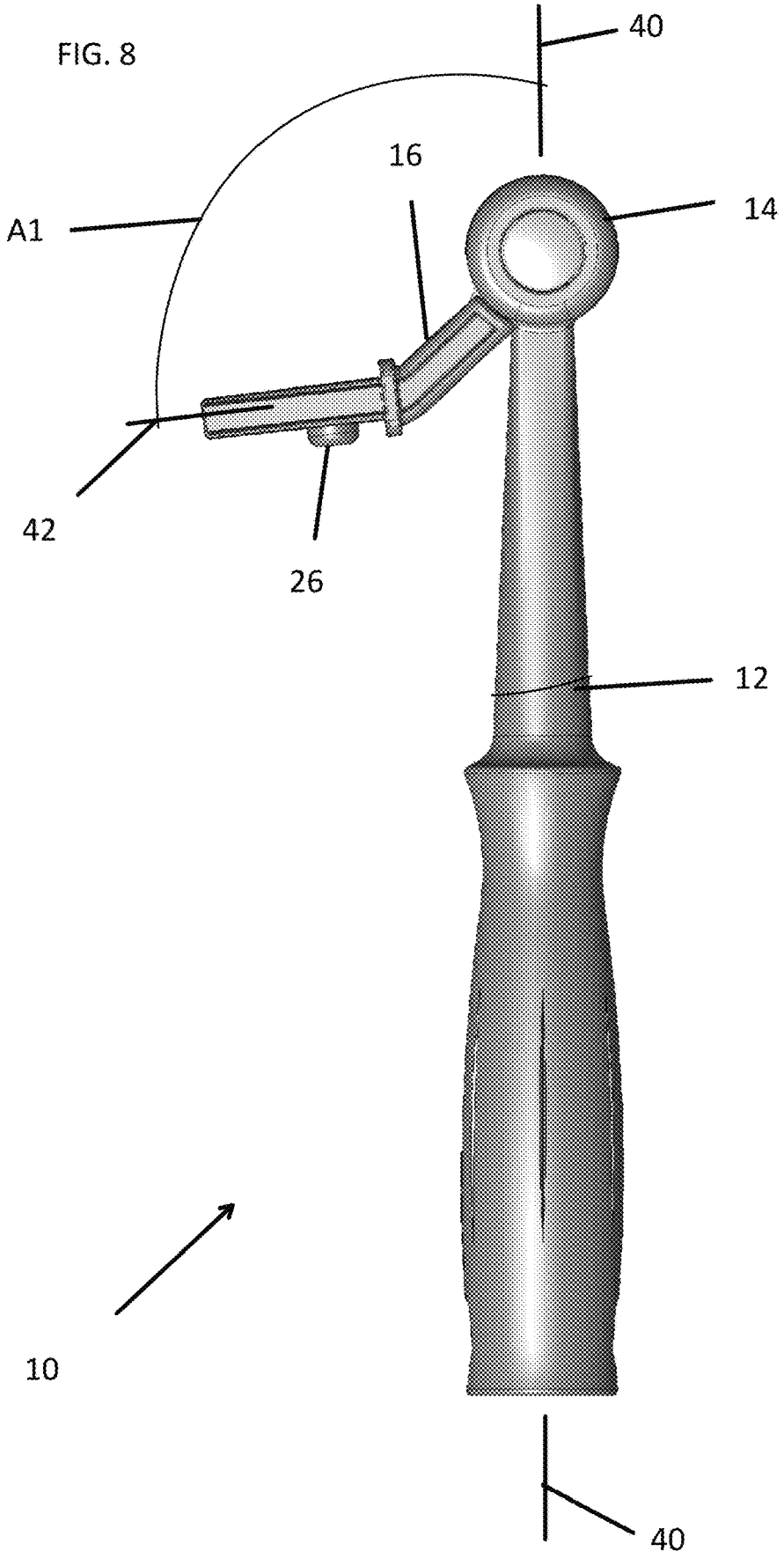
FIG. 8 is a side view of the cleaning device of FIG. 1 illustrated in a first rotated position.

Pivot assembly 14 allows device 10 to be configured with a first angle A1 between first axis 40 of handle 12 and second axis 42 of extension arm 16 when the extension arm is rotated to is left most position as shown in FIG. 8. Preferably, first angle A1 is equal to or greater than ninety (90) degrees—which allows one surface of first cleaning head 20 to be substantially perpendicular to handle 12.

Figure 9:
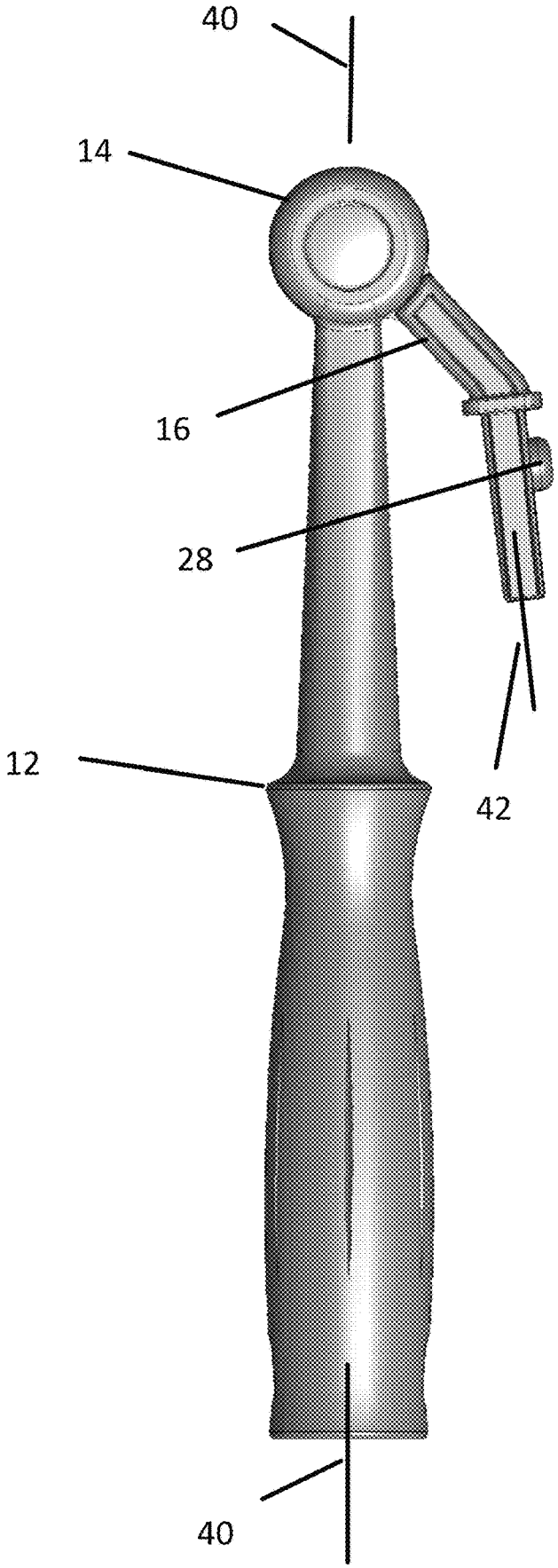
FIG. 9 is a side view of the cleaning device of FIG. 1 illustrated in a second rotated position.

Pivot assembly 14 also allows device 10 to be rotated from the position shown in FIG. 8 to the position shown in FIG. 9—where second axis 42 of extension arm 16 is about parallel to first axis 40 of handle 12.

In this manner, pivot assembly 14 provides extension arm 16 with 270 degrees or more of rotation and any degree of rotation therebetween. It has been determined by the present disclosure that pivot assembly 14 allows for both surfaces of first cleaning head 20 to be rotated to a position where they are substantially perpendicular to handle 12—which provides the user with the ability to clean using either surface without having to remove or replace cleaning member 22.

Figure 10:
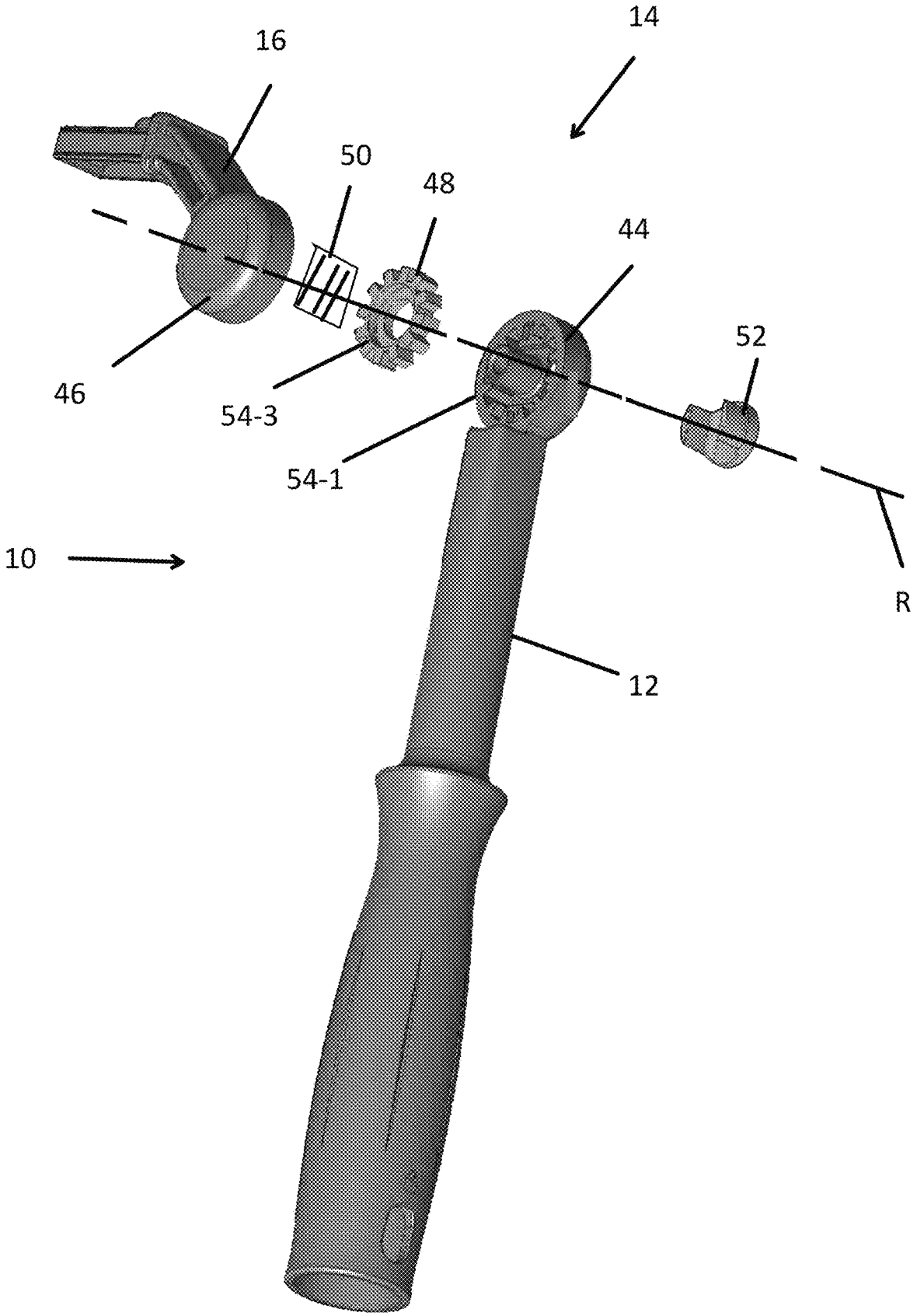
FIG. 10 is a front partially disassembled perspective view of the cleaning device of FIG. 1.
Figure 11:
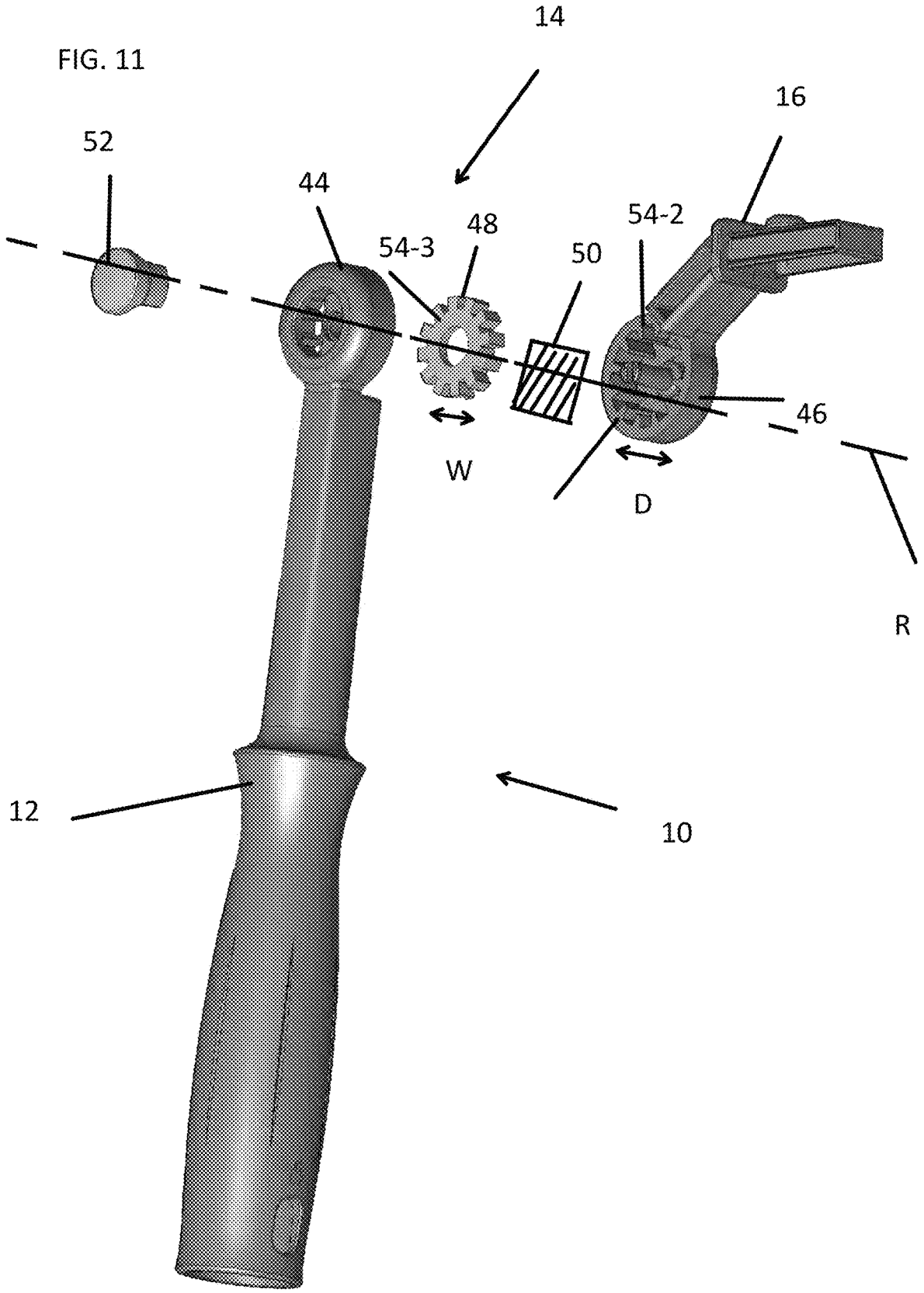
FIG. 11 is a bottom partially disassembled perspective view of the cleaning device of FIG. 1.

An exemplary embodiment of the structure of pivot assembly 14 is described with reference to FIGS. 10-11.

Pivot assembly 14 includes a first housing 44, a second housing 46, a gear lock 48, a biasing member 50, and a release button 52.

First housing 44 is formed as part of or connected to handle 12, while second housing 46 is formed as part of or connected to extension arm 16. Housings 44, 46 and gear lock 48 all have a corresponding number teeth 54-1, 54-2, and 54-3, respectively. Gear lock 48 is positioned in housings 44, 46 for sliding movement along the axis of rotation (R) of pivot assembly 14.

When teeth 54 of gear lock 48 are engaged with teeth 54-1, 54-2 of housings 44, 46, pivot assembly 14 is locked in position against rotation. Conversely, when teeth 54-3 of gear lock 48 are engaged with only teeth 54-1 or 54-2 of one of the housings 44, 46, pivot assembly 14 is released so as to be rotatable about the axis (R).

Gear lock 48 has a width (W) that is less than or equal to a depth (D) of second housing 46. In this manner, gear lock 48 can slide along the axis of rotation (R) entirely into second housing 46—to unlock pivot assembly 14—and can slide along the axis of rotation (R) into engagement with both first and second housings 44, 46.

Biasing member 50, illustrated as a compression spring, normally biases gear lock 48 along axis (R) into engagement with both first and second housings 44, 46. Thus, pivot assembly 14 is normally biased to a locked condition.

Release button 52 can also slide along the axis of rotation (R) and is accessible to the user through first housing 44—namely can depend from or be recessed into the first housing. Release button 52 abuts gear lock 48 so that pressure applied to the button inward towards first housing 44 over comes the force of biasing member 50—to slide the button and the gear lock into second housing 46 only—namely to the unlocked position. After rotation of device 10 to the desired position, pressure can be released from button 52 so that biasing member 50 biases gear lock 48 back into engagement with teeth 54-1 of first housing 44 but only when teeth 54-3 of the gear lock are aligned with the teeth 54-1 of the first housing.

Stated another way, gear lock 48 acts as a piston sliding axially along axis of rotation (R) with teeth 54-3 of the gear lock maintaining engagement with teeth 54-2 of second housing 46 along the entire travel of the gear, but releasing or no longer maintaining engagement with teeth 54-1 of first housing 44 when the gear lock is received in the second housing.

Figure 17:
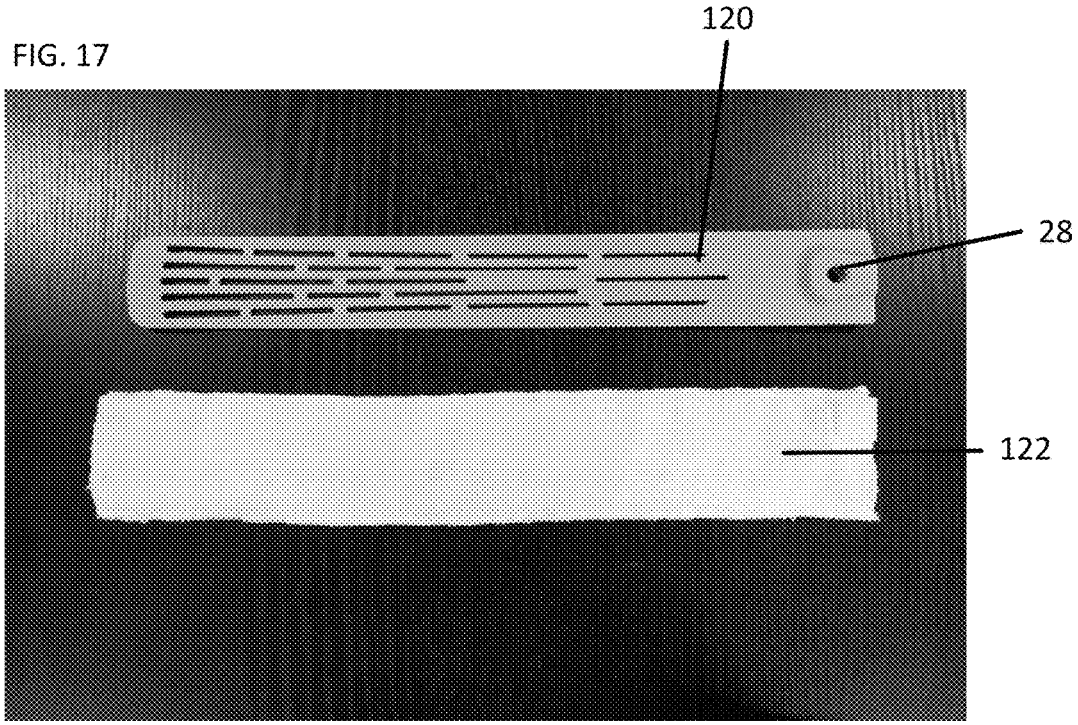
FIG. 17 illustrates the second cleaning head and member of FIG. 3 before assembly to one another.
Figure 18:
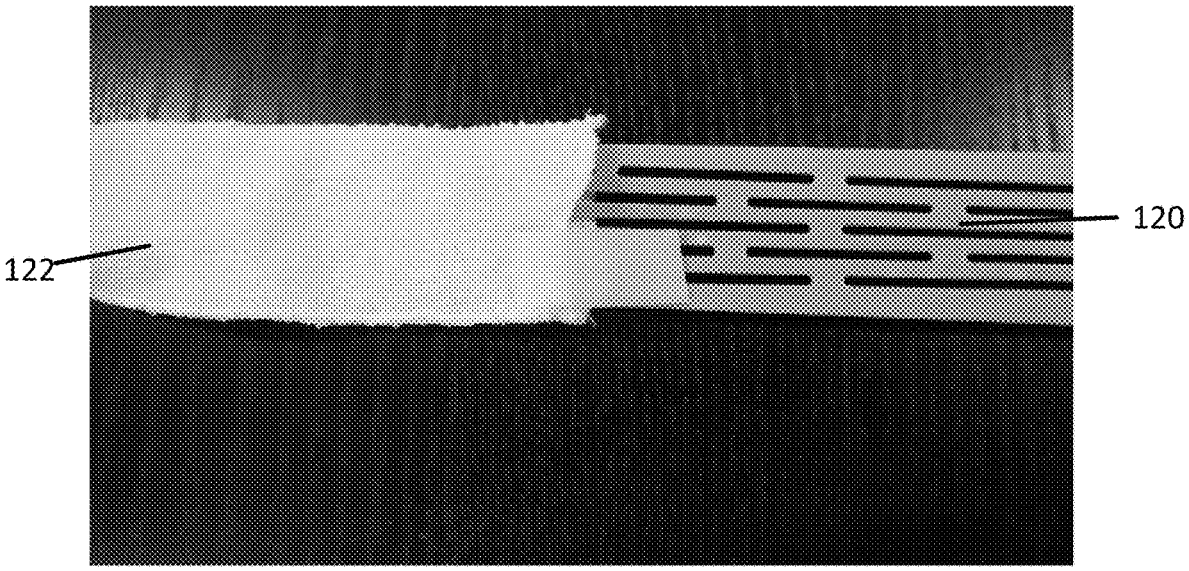
FIG. 18 illustrates the second cleaning head and member during assembly to one another.
Figure 19:
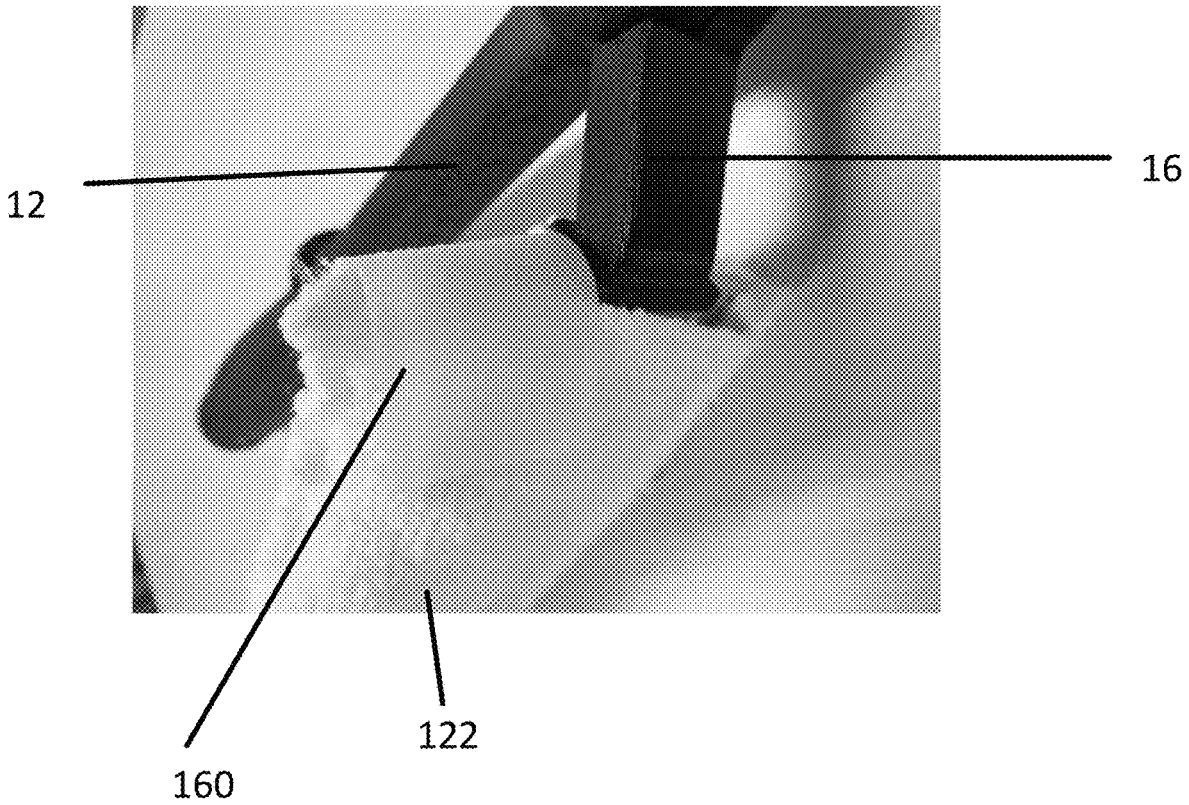
FIG. 19 illustrates the second cleaning head and member after assembly to one another.

In some embodiments, gear lock 48 is configured so that teeth 54-3 have a spacing that allows first cleaning head 20 can be located in the positions illustrated in FIGS. 8-9—preferably in positional increments of every 30 degrees First cleaning head 20 is described in more detail with respect to FIGS. 12-16, while second cleaning head 120 is described in more detail with respect to FIGS. 17-19.

Figure 12:
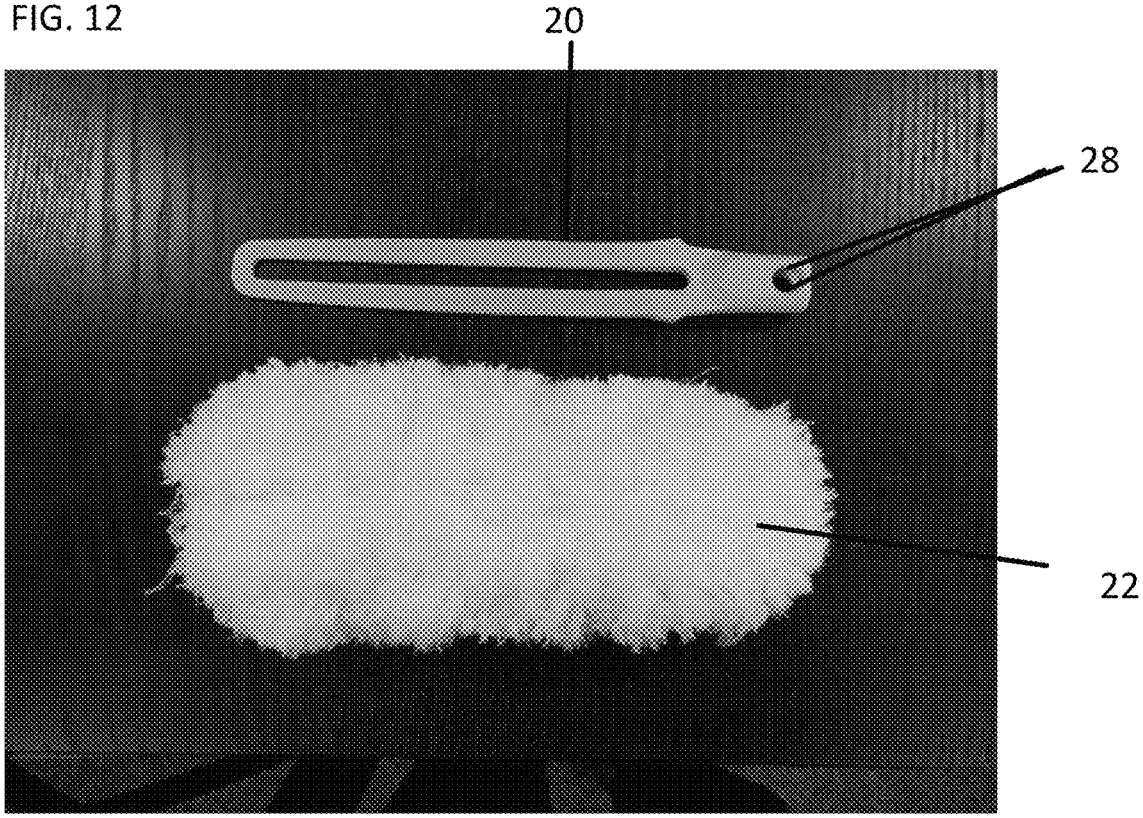
FIG. 12 illustrates the first cleaning head and member of FIG. 1 before assembly to one another.
Figure 13:
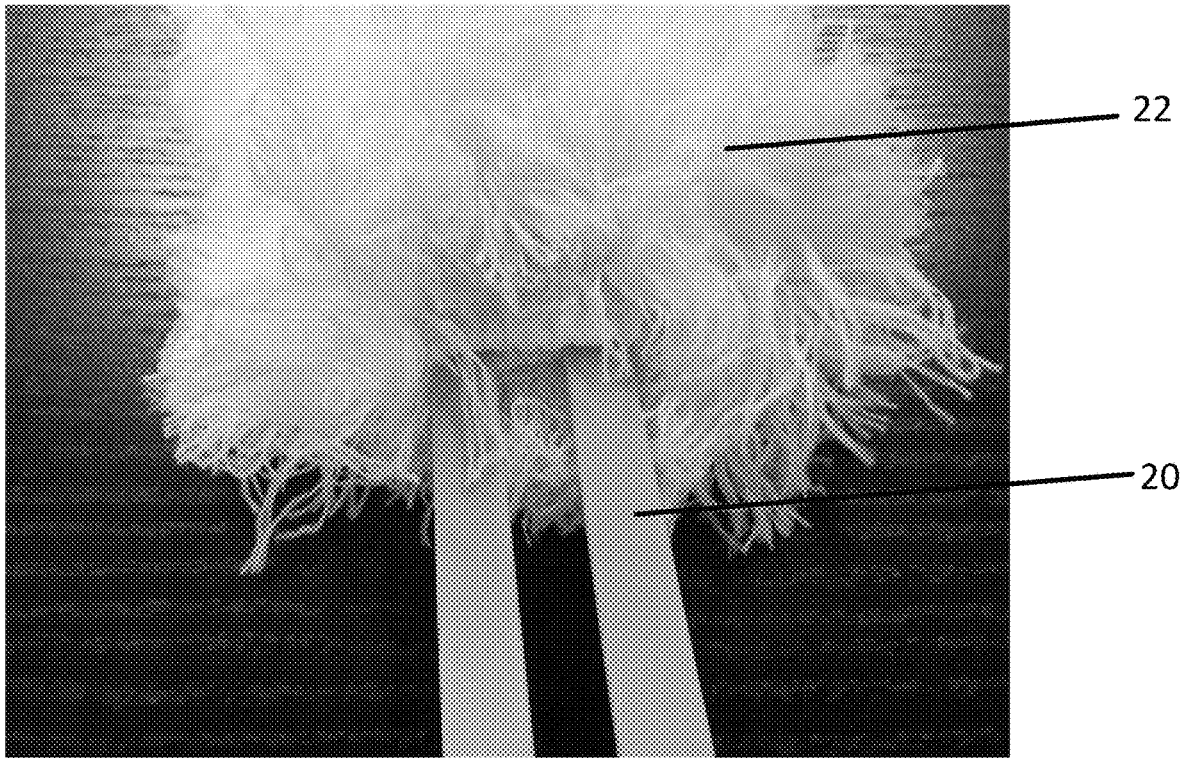
FIGS. 13-14 illustrate the first cleaning head and cleaning member during assembly to one another.
Figure 14:
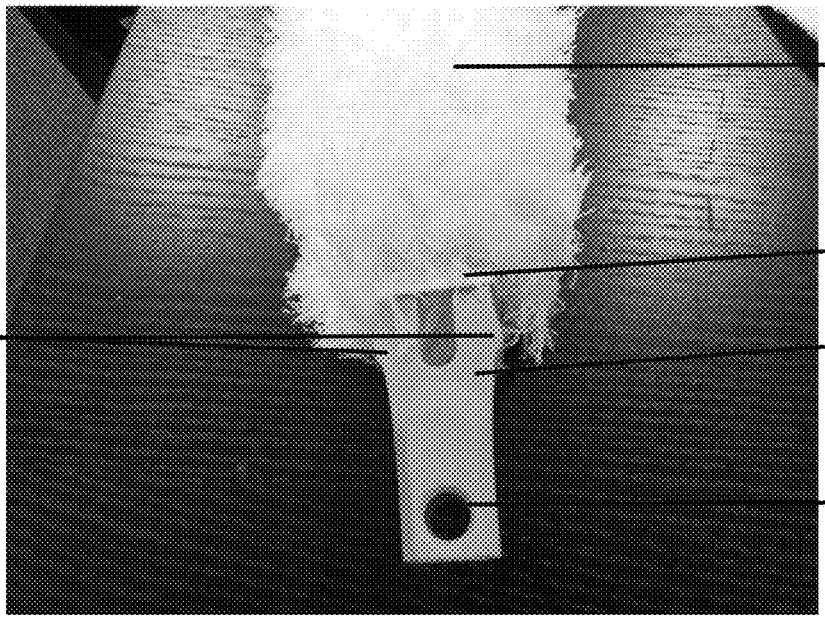
Figure 15:
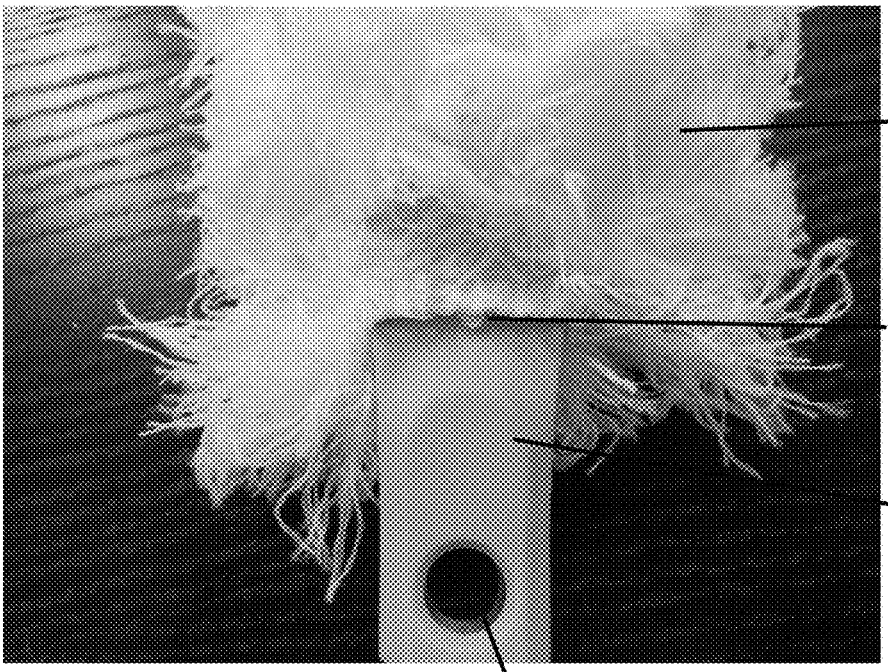
FIG. 15 illustrates the first cleaning head and cleaning member after assembly to one another.
Figure 16:
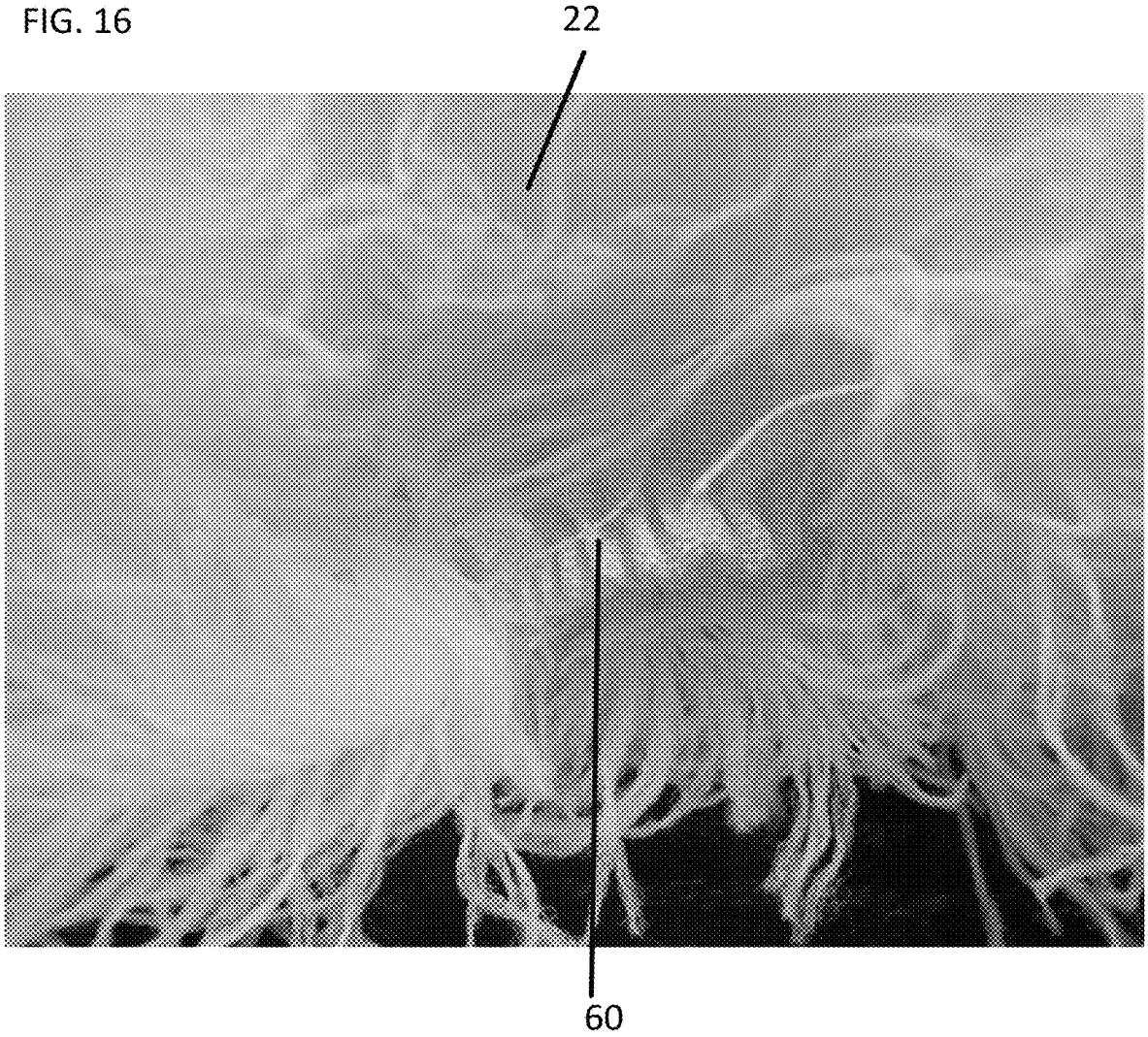
FIG. 16 illustrates a magnified view of an elastic retention feature of the first cleaning member.

First cleaning head 20 is illustrated in FIG. 12 before assembly with cleaning member 22, in FIGS. 13-14 during assembly with one another, and in FIG. 15 after assembly. Cleaning member 22 includes an elastic member 60, shown in FIGS. 15-16, that is stretched over and constricts around one or more shoulders 62 (two shown) of first cleaning head 20 to releasably secure the cleaning member to the first cleaning head. It should be recognized that first cleaning head 20 is described by way of example as having cleaning member 22 removably secured thereto by elastic member 60 and shoulder 62. Of course, any releasable connection structure is contemplated for use by the present disclosure such as, but not limited to, snaps, hook-and-loop type fasteners, buttons, draw strings, and others.

In some embodiments, first cleaning head 20 is reversible with respect to head attaching assembly 18—namely the first cleaning device has two second features 28—one on opposite sides as shown in FIG. 12.

Second cleaning head 120 is illustrated in FIG. 17 before assembly with cleaning member 122, in FIG. 18 during assembly with one another, and in FIG. 19 after assembly. Cleaning member 122 includes a retention member 160, shown in FIG. 19 as a hook-and-loop type fastener, which secures the cleaning member to device 10.

It is contemplated by the present disclosure for the components of cleaning device 10 to be made of any material having sufficient properties to achieve the functions disclosed here. By way of example, it is contemplated by the present disclosure for handle 12—including first housing 44—extension arm 16—including second housing 46, and button 52, to be made of polymers such as, but not limited to, thermoset and thermoplastic materials including polypropylene, polycarbonate, acetal (also known as polyoxymethylene or POM), and others.

Gear lock 48 and biasing member 50 can be made of thermoset and thermoplastic materials such as those discussed above, as well as of metal or alloys thereof—such as cast metallic materials.

Cleaning members 22, 122, 222 can be made of materials such as, but not limited to, natural fibers and/or man-made fibers including cotton, wool, microfiber, and others. Additionally, it is contemplated by the present disclosure for cleaning members 22, 122, 222 to be reversible—namely to be able to be turned inside-out-such that all sides of the members are usable. Moreover, cleaning members 22, 122, 222 are preferably washable—such as in a common residential or industrial washing machine.

As can be imagined, different cleaning tasks require different cleaning heads 20, 120, 220 configured for such tasks. Thus, the first cleaning head 20 is illustrated as a delicate duster for legit items such as figurines—where cleaning member 22 includes a small duster and with longer strands of microfibers. Conversely, second cleaning head 120 is illustrated as a crevice duster that is a thin flexible duster that allows cleaning member 122 to get between and under surfaces.

Accordingly and as described herein, versatile cleaning device 10 is configured to be easily configured for a number of different cleaning tasks and in a number of different positions. Device 10 allows the user to change and/or replace to cleaning head 20, 120, 220 and/or the cleaning member 22, 122, 222. Device 10 allows the user to change the first angle A1 between handle 12 and extension arm 16 via pivot assembly 18. Further, device 10 allows the user to secure handle 12 to an extension device for greater reach and cleaning range. Changing the angle A1 between handle 12 and extension arm 18—particularly when used in combination with the extension device—can allow for even greater reach and cleaning range, as well as allowing device 10 to be folded for easy and compact storage/shipping.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

LIST OF REFERENCE NUMERALS

| | |
|---|---|
| versatile cleaning device 10 | axis of rotation (R) |
| handle 12 | width (W) |
| pivot assembly 14 | depth (D) |
| extension arm 16 | elastic member 60 |
| head attaching assembly 18 | shoulders 62 |
| first cleaning head 20 | retention member 160 |
| cleaning member 22 | |
| free end 24 | |
| first feature 26 | |
| second feature 28 | |
| second cleaning head 120 | |
| cleaning device 122 | |
| third cleaning head 220 | |
| flexible spine 230 | |
| plurality of fibers 232 | |
| carrier 234 | |
| first axis 40 | |
| second axis 42 | |
| first angle A1 | |
| first housing 44 | |
| second housing 46 | |
| gear lock 48 | |
| biasing member 50 | |
| release button 52 | |
| teeth 54-1, 54-2, and 54-3 | |

What is claimed is:

1. A versatile cleaning device, comprising:

a handle defining a first axis;

an extension arm defining a second axis and having a first attaching feature;

a first cleaning head having a second attaching feature on a first end, the first and second attaching features being configured to removably secure the first cleaning head to the extension arm, the first cleaning head having a first cleaning member;

a second cleaning head having a third attaching feature on a second end, the first and third attaching features being configured to removably secure the second cleaning head to the extension arm, the second cleaning head having a second cleaning member, the second cleaning member being different than the first cleaning member; and a pivot assembly securing the handle and extension arm to one another for rotational movement about a pivot axis among a first position, at least one intermediate position, and a second position, the pivot assembly having a release button configured to selectively allow or prevent movement among the first, intermediate, and second positions, wherein the first position is configured so that first and second axes are perpendicular to one another, the second position is configured so that the first and second axes are parallel to but offset from one another, and the first and second positions are offset from one another by at least 270 degrees.

2. The device of claim 1, wherein the extension arm comprises one or more bends along the second axis.

3. The device of claim 1, wherein the first cleaning member is a crevice duster and the second cleaning member is a feather duster.

4. The device of claim 1, wherein the handle and a portion of the pivot assembly are integrally formed and/or the extension arm and another portion of the pivot assembly are integrally formed.

5. The device of claim 1, wherein the handle comprises a free end opposite to the pivot assembly, the free end being configured to removably receive an extension device.

6. The device of claim 1, wherein the extension arm comprises one or more bends along the second axis.

7. A versatile cleaning device, comprising:

a handle defining a first axis;

an extension arm defining a second axis;

a head attaching assembly configured to removably secure an end portion of a plurality of cleaning heads to the extension arm, each of the plurality of cleaning heads having a different cleaning member; and a pivot assembly securing the handle and extension arm to one another for rotational movement about a pivot axis among a first position, at least one intermediate position, and a second position, wherein the first position is configured so that first and second axes are perpendicular to one another, wherein the second position is configured so that the first and second axes are parallel to and offset from one another, wherein the plurality of cleaning heads includes a first cleaning head removably secured to the extension arm, and wherein the head attaching assembly comprises a first feature and the first cleaning head comprises a second feature on the end portion, one of the first and second features comprising a release button and the other of the first and second features comprising opening sufficient to removably receive the release button to allow the user to removably secure the first cleaning head and the head attaching assembly to one another and separate the first cleaning head and the head attaching assembly from one another, wherein the head attachment assembly defines a third axis, the third axis being on an angle relative to the second axis;

the first position is on a first side of the handle;

the second position is on a second side of the handle; and the first position and the second position are offset from one another by at least 270 degrees.

8. The device of claim 7, wherein the handle and a portion of the pivot assembly are integrally formed and/or the extension arm and another portion of the pivot assembly are integrally formed.

9. The device of claim 7, wherein the handle comprises a free end opposite to the pivot assembly, the free end being configured to removably receive an extension device.

10. The device of claim 7, wherein the extension arm comprises one or more bends along the second axis.

11. The device of claim 7, wherein the release button comprises a lead in configured to bias the release button until the release button is aligned with the opening during connecting of the first cleaning head and the extension arm, at which time the release button returns to a normal state under its own resilience.

12. The device of claim 7, wherein the pivot assembly comprises:

a first housing formed as part of or connected to one of the handle and the extension arm;

a second housing formed as part of or connected to the other one of the handle and the extension arm;

a gear lock positioned in the first and second housings for sliding movement along the pivot axis, the first and second housings and the gear lock all have a corresponding number of teeth, respectively, the gear lock having a width that is less than or equal to a depth of the second housing so that the gear lock can slide along the pivot axis into the second housing with the teeth of the gear lock being engaged with only the teeth of the second housing;

a biasing member in one of the first and second housings, the biasing member normally biasing the gear lock to a position in which the teeth of the gear lock are engaged with the teeth of both the first and second housings to lock the pivot assembly in position against rotation about the pivot axis; and a release button positioned in and extending from one of the first and second housings, the release button abutting the gear lock so that a pressure applied to the release button over comes the biasing force of the bias member and slides the gear lock along the pivot axis into the second housing to unlock the pivot assembly for rotation about the pivot axis.

13. The device of claim 12, wherein the biasing member, after release of the pressure, slides the gear lock back into the first housing so that the teeth of the gear lock are engaged with the teeth of both the first and second housings.

14. The device of claim 12, wherein the biasing member comprises a compression spring.

15. The device of claim 12, wherein the number of teeth are configured so that the at least one intermediate position comprises a plurality of positions.

16. The device of claim 15, wherein the plurality of positions comprises positional increments with respect to one another of every 30 degrees.

17. The device of claim 15, wherein the plurality of cleaning heads comprise a head selected from the group consisting of a delicate duster, a crevice duster, and feather duster.

18. The device of claim 7, wherein the each of the plurality of cleaning heads structurally supports the respective cleaning member.

19. The device of claim 7, wherein the plurality of cleaning heads include a delicate duster, a crevice duster and a feather duster.

* * * * *